United States Patent [19]

Grane

[11] 4,170,427

[45] Oct. 9, 1979

[54] VIBRATING TAMPER

[75] Inventor: Gunnar Grane, Lyckeby, Sweden

[73] Assignee: Dynapac Maskin Aktiebolag, Solna, Sweden

[21] Appl. No.: 896,200

[22] Filed: Apr. 13, 1978

[30] Foreign Application Priority Data

Apr. 14, 1977 [SE] Sweden ..... 7704260

[51] Int. Cl.[2] ..... E01C 19/35

[52] U.S. Cl. ..... 404/133

[58] Field of Search ..... 404/133, 117, 114, 113

[56] References Cited

U.S. PATENT DOCUMENTS

| | | | |
|---|---|---|---|
| 3,109,354 | 11/1963 | VanKirk | 404/133 |
| 3,386,303 | 6/1968 | Curlett | 404/133 X |
| 3,483,805 | 12/1969 | Hirn | 404/133 |
| 3,603,225 | 9/1971 | Buck | 404/133 |
| 3,856,426 | 12/1974 | Waschulewski | 404/133 |

*Primary Examiner*—Nile C. Byers, Jr.

*Attorney, Agent, or Firm*—Brumbaugh, Graves, Donohue & Raymond

[57] ABSTRACT

A vibrating tamper with side-by-side engine section and tamper section connected by a suspension system including leaf springs. The tamper section includes a reciprocating leg terminating in a tamping plate. The engine section includes handles, an engine with a rotary drive shaft, and a transmission for converting the drive shaft rotary motion to reciprocating motion to be imparted to the tamper. A driven, eccentrically mounted roller cooperates with a lever forked at one end to embrace the roller. At its other end, the lever applies reciprocating drive to the tamper. The reciprocating drive is applied through helical springs encircling the tamper leg. The forked lever end and eccentric assure that forces substantially parallel the axis of the tamper leg are transmitted to the tamper section, minimizing forces perpendicular the leg. The leaf springs permit only axial reciprocating movement of the leg back and forth along its longitudinal axis relative to the engine and they isolate much of the axial force from the engine section.

10 Claims, 2 Drawing Figures

VIBRATING TAMPER

BACKGROUND OF THE INVENTION

This invention relates to vibrating tampers or tamping machines that include an engine section and a tamper section. More particularly the invention relates to a tamper with side-by-side engine and tamper sections reducing structural height, but with a minimum of joints and frictional sliding guides in the structural interconnection and power transmission connections between the engine and tamper sections.

An appreciable problem in connection with tamping machines of the type in question has been the difficulty of achieving low structural height, which is important for achieving the greatest possible stability. By locating the engine level with and beside the tamper section, instead of immediately above it, the structural height of the tamping machine can be substantially reduced. However, this arrangement gives rise to the problem of reducing the number of joints and frictional sliding guides in the mounting and power transmission systems which make possible relative movement between engine and tamper sections.

In known constructions of this kind link arms have connected the engine and tamper sections. These have been arranged horizontally in the direction of forward movement of the tamper. The link arms have had hinged connections at both the engine and tamper sections. Also in known constructions, a lever pivoted on the motor section, and driven from a connecting rod journalled eccentrically on the engine drive shaft, has been employed to transmit power to the tamper section from the engine. In this way, the rotational motion of the drive shaft has been converted to chiefly vertical reciprocating motion applied to the tamper. Although this construction has achieved the desired reduction in structural height, the power and structural interconnections have not been satisfactorily strong, and too many joints in the interconnecting parts have complicated the structure more than desired. The requirements of the members interconnecting the tamper and engine sections are made more troublesome by the need to withstand severe oblique loads which the tamper encounters in operation. Moreover, the link arm type of interconnection or suspension system also imparts a fairly substantially horizontal component in the relative motion between the engine and tamper section. This horizontal component must be compensated, for example by specially arranged cushioning.

SUMMARY OF THE INVENTION

The purpose of this invention is to eliminate the foregoing drawbacks in tampers with side-mounted engines. In the structural interconnection of the tamper and engine sections of this invention, the aforementioned link arms are eliminated. The tamper section is resiliently connected to the engine section. The drive connections to the tamper section include an eccentric and lever arrangement that substantially eliminates forces in the direction perpendicular to the tamper's reciprocating movement.

Leaf springs are the resilient means that support the engine section on the tamper section. The springs are parallel and principally horizontal, i.e. perpendicular the axis of the tamper leg. They extend across the front of the tamper engine section perpendicular to the direction of forward movement of the tamper. The leaf springs are rigidly attached to both the engine and tamper sections.

By using the leaf spring suspension system to interconnect the two major sections of the tamper the number of joints between the sections is reduced. Improved stabilization of the tamper reciprocating movement is conferred whereby frictional sliding guides for the tamper sections movement relative to the engine can be dispensed with altogether.

In the power transmission interconnections between the engine and the tamper sections, the lever that drives the tamper is forked at one end. The eccentric that drives the lever protrudes into the slot between the two sections of the levers forked end. The eccentric is driven from the engine's rotary drive shaft and transmits to the forked end of the lever forces that are substantially parallel to the direction of the tamper's reciprocating movement.

The invention will be further described in relation to the following exemplary embodiment and in reference to the attached drawing.

DESCRIPTION OF PREFERRED EMBODIMENTS

Figure 1:
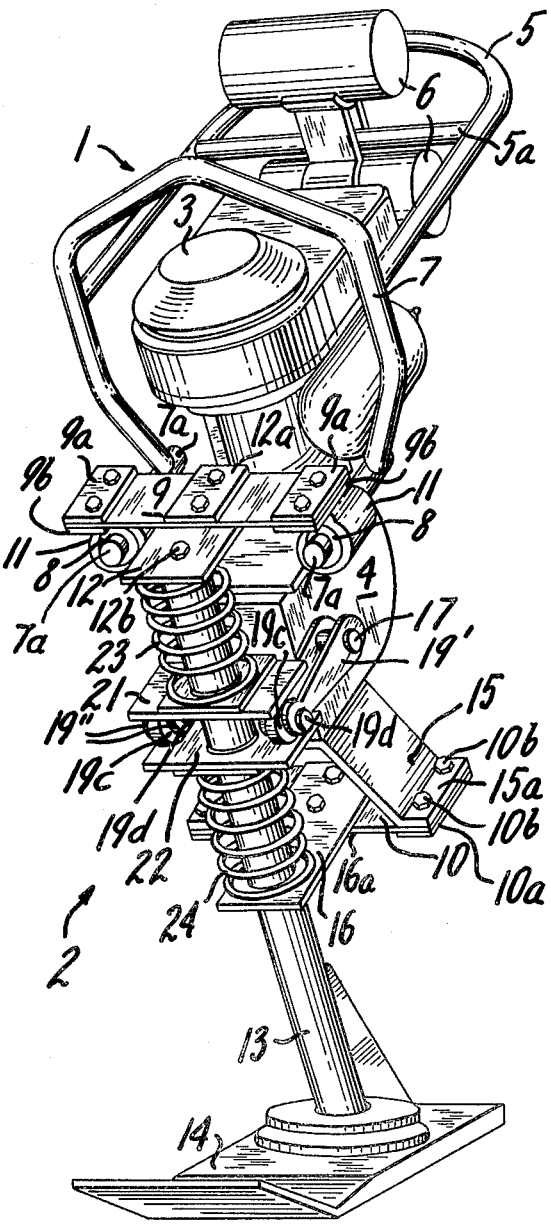
FIG. 1 is a perspective view of a vibrating tamper according to this invention with side-by-side tamper and engine section.

FIG. 1 illustrates a tamper with an engine section 1 and a tamper section 2. The engine section includes an engine 3, transmission 4, and handle 5. The handle 5 serves as the means by which the tamper is held during its operation. The handle includes a cross brace 5*a*, on which is mounted a pair of fuel tanks 6. The handle 5 also incorporates a protective arch 7 over the engine 3. Finally, a pair of rubber or rubber-like bushings 8 receive a pair of forwardly projecting handle ends 7*a* in a pair of casings 11 that are secured to the engine section 1.

One upper leaf spring 9 and one lower leaf spring 10 resiliently attach the engine section 1 to the tamper section 2. The leaf springs 9 and 10 are parallel and arranged substantially perpendicular to the axis of a tamper leg 13. The springs are substantially perpendicular to both the horizontal or forward and the reciprocating or vertical directions of movement of the tamper section.

Pairs of upper and lower clamping plates 9*a* and 9*b* clamp the ends of the upper leaf spring 9 to the bushing casings 11 by means of bolts or other suitably chosen fasteners. At the center of the leaf spring 9, a flat bar 12 is clamped by a plate 12*a* and suitable fastening means. The bar 12 extends forward from the leaf spring to secure the upper end of the tamper leg 13 by, for example, a bolt 12*b*. The bar 12, then, attaches the leg 13 to the upper leaf spring 9 for reciprocating movement of the leg 13. Leg 13 is slightly inclined from the vertical to provide a forward thrust as the overall tamper operates, and a generally horizontally disposed tamping plate 14 is affixed to the lower end of the leg.

The lower leaf spring 10 is similarly mounted on the engine section and attached to the leg 13. A yoke 15, affixed in any suitable fashion to the engine section, has outturned ends 15*a* to which are clamped the ends of the spring 10 by a clamping plate 10*a* and threaded fasteners, bolts 10*b* or the like. The center of this leaf spring is firmly connected by means of a flat bar 16 to the tamper leg 13. Again a clamping plate 16*a* and associated bolts or the like firmly affix the plate 16 to the leaf spring 10. With respect to both leaf springs 9 and 10, clamping across their entire width is employed to avoid affecting the spring constant and to avoid weakening these springs.

Figure 2:
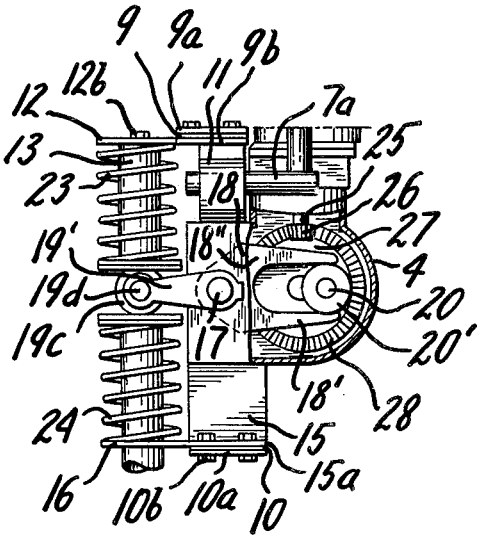
FIG. 2 is fragmentary side elevation view of the tamper of FIG. 1, with parts broken away for clarity to show a forked lever and eccentric drive.

FIG. 2 illustrates the means for transmitting reciprocating motion to the tamper leg 13 from a rotary drive shaft 25. The drive shaft 25 of the engine 3 bears a bevel gear 26 that engages a ring gear 28 affixed to or forming the periphery of a rotatable disc 27. Onto the disc, and inwardly of the ring gear 28, an eccentric stud 20 supports a roller 20'. Rotary movement of the drive shaft 25 imparts circular movement to the stud and roller, 20 and 20'.

Between the eccentric roller 20' and the tamper leg 13 extends drive lever that includes a forked end 18, shaft 17, and arms 19' and 19'', all fixedly interconnected. The shaft 17 is suitably journalled for pivotal movement about its axis, for example in the housing of the transmission 4 as shown. The forked lever end 18 embraces the roller 20' within a slot formed between upper and lower fork parts or parallel projections 18'' and 18', respectively. These are located one above the other in a vertical plane in which they move as shown in FIG. 2. Rotary movement of the drive shaft 25 causes pivotal oscillation of the lever end 18 and arms 19' and 19'' about the axis of the pivotal shaft 17. The eccentric roller 20' drives the lever end 18 upward by its engagement with the upper part 18'' of the fork, and then drives the lever end down by its engagement with the lower part 18'.

The two arms 19' and 19'' that extend from the shaft 17 to drive the tamper are each bifurcated and include two extensions 19*a* and 19*b* that reach between a pair of upper and lower drive plates 21 and 22, through which the tamper leg 13 extends. On each side of the leg, the plates 21 and 22 are interconnected by a boss 19*c*. The leg extensions 19*a* and 19*b* of the drive lever embrace the bosses 19*c* and a pair of pins 19*d* pivotally connects the extension ends and the bosses. The drive lever is thus pivotally connected to the drive plates 21 and 22 to cause oscillatory movement of the plates when the eccentric roller 20' drives the lever end 18.

An upper helical spring 23 encircles the leg and extends, in tension, between the upper leaf spring mounted bar 12 to the upper drive plate 21. A second, lower helical spring 24 encircles the leg 13 and extends, in tension, from the lower leaf spring mounted bar 16 to the lower drive plate 22. The ends of the helical springs are attached to the plates 21 and 22, and to the bars 12 and 16. Reciprocating forces are applied by the plate 21 and 22 to the helical springs 23 and 24 and by the helical springs to the tamper leg 13 by the leaf spring mounted upper and lower bars 12 and 16 that are connected to the leg.

Because the leg 13 forms a slight angle with the vertical, leaning slightly forward as shown in FIG. 1, the tamping motion is not entirely vertical and a horizontal component imparts a forward motion to the tamper. The leaf springs 9 and 10 prevent much of the tamping motion being imparted to the engine section of the tamper. What motion is imparted to the engine section is dependent on the distribution of mass between the engine and tamper sections.

The foregoing details of a specific embodiment of the invention are illustrative only, and the description thereof is not to be construed as limiting the scope of protection of the invention. That scope is defined in the appended claims.

I claim:

1. A manually controlled vibrating tamper for the compaction of soil, concrete, asphalt and similar materials, the tamper comprising a tamper section having a tamping plate, and an engine section having an engine resiliently connected to the tamper section by two parallel leaf springs arranged at right angles to the vibratory and horizontal forward motion of the tamper and attached at their ends and center portions to the engine section and the tamper section respectively, a forked lever pivoted on the engine section for transmitting power from the engine section to the tamper section and for imparting a forward tamping motion to the tamper, the forked lever being connected at one end with a spring system arranged on the tamper section, the other end of the lever having two parallel projections embracing an eccentric stud adapted to be driven by the engine, the fork projections being oriented in a vertical plane when said tamper is in its operative position and at right angles to the longitudinal direction of the leaf springs.

2. The vibrating tamper according to claim 1, wherein the center portions of the leaf springs are clamped rigidly to the tamper section by flat bars.

3. The vibrating tamper according to claim 1, wherein a roller rotatably mounted on the eccentric stud engages the opposed surfaces of the two fork projections of the lever during rotational motion of the eccentric stud.

4. The vibrating tamper according to claim 1, wherein the end of the lever connected with said spring system comprises two parallel arms rigidly connected to each other, extending from a pivot shaft journalled in the engine section to the tamper section and which at their outer ends are pivotally connected to said spring means, and said spring means comprise helical springs for transmitting driving forces from the lever to the tamper section.

5. A vibratory tamper having a tamper section and an engine section, means structurally interconnecting the tamper and engine sections including spring means supporting the engine section on and besides said tamper section, and means connecting the engine section in driving relation to the tamper section to cause reciprocating movement of the tamper section relative to the engine section, the spring means including an upper and a lower leaf spring, each secured at its ends to one of the engine and tamper sections, and each secured at its middle to the other of said sections.

6. A vibratory tamper according to claim 5, wherein the tamper section includes a leg connected to a tamper plate, said spring means including first and second plates connected to the upper and lower leaf springs and to the leg at spaced locations thereon, the leaf springs being adapted to permit reciprocating motion of the tamper plate and tamper leg relative to the engine section substantially only in the direction of the axis of the tamper leg, at least one helical spring encircling the leg, and a reciprocatable drive member connected to the engine section and located between the leaf springs at said leg, the helical spring being connected between the drive member and at least one of the first and second plates to impart oscillatory motion to the leg.

7. A vibratory tamper of the kind having a tamper section, with a tamper leg terminating in a tamper plate, an engine section mounted to one side of the tamper section, and drive means for imparting reciprocating tamping motion to the tamper leg and plate; said drive means including an eccentric in driven relationship to said engine, a lever having a forked end defining a slot wherein said eccentric is located, a pivotal support on the engine section for the lever and a further lever end operatively connected to said tamper leg for applying reciprocating motion to the tamper leg.

8. The vibratory tamper according to claim 7 further comprising spring means interconnecting the further end of the lever and said leg to apply the reciprocating motion to the leg from the lever.

9. The vibratory tamper according to claim 8, wherein said spring means comprise first and second helical springs encircling said leg, said lever includes a pair of arms straddling said leg, means pivotally connected to the lever arms engaging the springs, and means connecting each spring end remote from the lever in force transmitting relation to the leg.

10. The vibratory tamper according to claim 9 further including leaf springs interconnecting the tamper and engine sections for relative movement.

* * * * *